US005572902A

United States Patent [19]

Kawano

[11] Patent Number: 5,572,902

[45] Date of Patent: Nov. 12, 1996

[54] UPPER TOOL HOLDER APPARATUS FOR PRESS BRAKE AND UPPER TOOL ATTACHABLE THERETO

[75] Inventor: Susumu Kawano, Atsugi, Japan

[73] Assignee: Amada Metrecs Company, Limited, Kanagawa, Japan

[21] Appl. No.: 375,734

[22] Filed: Jan. 20, 1995

Related U.S. Application Data

[63] Continuation of Ser. No. 177,988, Jan. 6, 1994, Pat. No. 5,390,527.

[30] Foreign Application Priority Data

| | | | |
|---|---|---|---|
| May 18, 1993 | [JP] | Japan | 5-115655 |
| May 18, 1993 | [JP] | Japan | 5-115665 |
| Aug. 25, 1993 | [JP] | Japan | 5-210344 |

[51] Int. Cl.[6] ..... B21D 37/04

[52] U.S. Cl. ..... 72/482.91; 72/389.3; 72/481.1; 72/481.6; 72/462

[58] Field of Search ..... 72/389, 462, 481, 72/482, 481.1, 481.3, 481.6, 481.7, 481.8, 482.91, 389.3

[56] References Cited

U.S. PATENT DOCUMENTS

| | | | |
|---|---|---|---|
| 4,895,014 | 1/1990 | Houston | 72/481 |
| 5,022,256 | 6/1991 | Van der Meulen | 72/481 |
| 5,390,527 | 2/1995 | Kwano | 72/481 |

FOREIGN PATENT DOCUMENTS

| | | | |
|---|---|---|---|
| 0387121 | 9/1990 | European Pat. Off. . | |
| 569880 | 11/1993 | European Pat. Off. . | |
| 577974 | 1/1994 | European Pat. Off. . | |
| 2339485 | 8/1979 | France | 72/481 |
| 2427148 | 2/1980 | France | 72/481 |
| 2609909 | 7/1988 | France | 72/481 |
| 3136440 | 3/1983 | Germany | 72/481 |
| 3524694 | 1/1987 | Germany | 72/481 |
| 4115224 | 11/1992 | Germany | 72/481 |
| 56218 | 4/1962 | Japan . | |
| 0212019 | 9/1987 | Japan | 72/481 |
| 0186220 | 7/1989 | Japan | 72/481 |
| 47462 | 2/1994 | Japan | 72/481 |

*Primary Examiner*—David Jones

*Attorney, Agent, or Firm*—Wigman, Cohen, Leitner & Myers, P.C.

[57] ABSTRACT

An upper tool holder apparatus (1) for removably supporting an upper tool (9) on an upper table (3) of a press brake includes: a holder body (5) removably attached to the upper table; an upper tool clamp (11) attached to the holder body, for pushing and fixing an upper portion of the upper tool to a support plate (7) provided at a lower portion of the holder body; a clamping force adjusting device (13) for adjusting a clamping force of the upper tool clamp; and a clamp releasing device (15) for releasing the upper tool clamped by the upper tool clamp. In particular, a wedge-shaped member (17) vertically movably provided at a lower portion of the upper tool clamp is formed with a stop portion (17K) engageable with and disengageable from an engage portion (9K) formed in the upper tool (9). Further, an upper tool (9) for a press brake includes: a contact surface (6F) contactable to a lower surface of a support plate (7) provided at a lower portion of a holder body (5) of an upper tool holder apparatus (1) attached to an upper table (3) of a press brake; a slide surface (9S) slidably contactable to a front or rear surface of the support plate; an engage portion (9K) engageable with and disengageable from a stop portion (17K) of a wedge-shaped member (17) vertically movably provided at an lower portion of an upper tool clamp (11) pivotally attached to the upper tool holder apparatus (1); and a work processing portion (9M) for processing a work in cooperation with a lower tool.

9 Claims, 9 Drawing Sheets

UPPER TOOL HOLDER APPARATUS FOR PRESS BRAKE AND UPPER TOOL ATTACHABLE THERETO

This is a continuation of application Ser. No. 08/177,988 filed on Jan. 6, 1994, now U.S. Pat. No. 5,390,527.

BACKGROUND OF THE INVENTION

1. Field of the Invention

The present invention relates to an upper tool holder apparatus for a press brake and an upper tool removably attachable to the same upper tool holder apparatus, and more specifically to an upper tool holder apparatus and an upper tool by both of which the upper tool can be easily attached to and removed from an upper table of a press brake.

2. Description of the Related Art

As is well known, a press brake is of such a structure that an upper table (referred to as an upper apron, sometimes) and a lower table (referred to as a lower apron, sometimes) are provided so as to be vertically opposed to each other and further any one of the upper and lower tables is moved up and down relative to the other as a ram.

Further, in the press brake, an upper tool is attached to the lower portion of the upper table and a lower tool is attached to the upper portion of the lower table.

In the above-mentioned structure, a workpiece disposed between the upper and lower tools can be bent when both the tools are engaged with each other by moving the movable-side table up and down.

In the above-mentioned press brake, in order to exchange an upper tool with another upper tool according to the bending shape of workpiece, a number of upper tool holders are attached to the lower portion of the upper table, and further a number of tools are removably supported by a number of the upper tool holders, respectively.

Here, in the conventional upper tool holder, an upper tool clamp is mounted on a holder body attached to the lower portion of the upper table, and the upper portion of the upper tool is strongly fastened and fixed between the holder body and the upper tool clamp when the upper clamp is fastened with fastening bolts.

In the conventional upper tool holder, therefore, a great number of fastening bolts arranged on a number of upper tool holders must be rotated in order to exchange the upper tool on the upper table, thus causing a problem in that the tool exchange work is complicated and therefore troublesome.

To overcome the above-mentioned problem, another upper tool holder apparatus has been so far proposed such that an air cylinder is attached for each upper tool holder to fasten and unfasten the upper tool clamp with the use of the attached air cylinder, respectively.

In this prior art upper tool holder apparatus, however, since a number of air cylinders must be provided for a number of the upper tool holder apparatuses independently, and further since air source is required additionally, there exists another problem in that the structure is complicated and therefore the manufacturing cost thereof is high.

Further, in the prior art upper tool holder apparatus, whenever the upper tool is unclamped by releasing the upper tool clamp provided for the upper tool holder, there exists such a danger that the released upper tool falls down. Further, in the prior art upper tool holder apparatus, during the upper tool setting work, since the upper tool must be first fastened slightly to such an extent that the upper tool will not fall and then the upper tool must be fastened strongly with the upper tool clamp after the alignment of both the upper and lower tools has been confirmed, there exists another problem in that the upper tool setting work is troublesome.

Further, there is another prior art as disclosed by a document EP-0 387 121 A1 related to the present invention, whose structure is such that an upper tool is clamped between an upper tool holder body and an upper tool clamp pivotally attached to the upper table of a press brake. In this structure, however, since the upper tool must be attached to and removed from the upper tool holder body by pivoting the upper tool about the pivotal axle of the upper tool clamp, there exists such a shortcoming that the shape of the upper tool is restricted.

SUMMARY OF THE INVENTION

With these problems in mind, therefore, it is the primary object of the present invention to provide an upper tool holder apparatus and an upper tool removably attachable to the same upper tool holder, by which the upper tool can be exchanged easily, without dropping the upper tool, even when the upper tool is released from clamping.

To achieve the above-mentioned object, the present invention provides an upper tool holder apparatus for removably supporting an upper tool on an upper table of a press brake, which comprises: a holder body removably attached to the upper table; an upper tool clamp attached to said holder body, for pushing and fixing an upper portion of the upper tool to a support plate provided at a lower portion of said holder body; a clamping force adjusting device for adjusting a clamping force of said upper tool clamp; and a clamp releasing device for releasing the upper tool clamped by said upper tool clamp; and wherein a wedge-shaped member vertically movably provided at a lower portion of said upper tool clamp is formed with a stop portion engageable with and disengageable from an engage portion formed in the upper tool.

Further, said upper tool clamp is pivotally attached to said holder body in such a way that tile lower portion of said upper tool clamp is movable toward and away from the support plate; an upper portion of said upper tool clamp is urged away from said holder body by said clamping force adjusting device attached to said holder body; said clamping force adjusting device provided on the upper portion of said upper tool clamp includes a fastening screw screwed into the upper portion of said upper tool clamp; and an end portion of the fastening screw is in contact with said clamping force adjusting device.

Further, said clamping force adjusting device comprises a nut member engaged with an adjust screw, for adjusting a position of a ring member movably fitted to the adjust screw; and an elastic member disposed between the adjust screw and the ring member.

Further, said two upper tool clamps are pivotally attached to both front and rear sides of said holder body, respectively; and said clamping force adjusting device is used in common for both said upper tool clamps.

Further, the present invention provides an upper tool holder apparatus for removably supporting an upper tool on an upper table of a press brake, which comprises: a holder body removably attached to the upper table; an upper tool clamp attached to said holder body, for pushing and fixing an upper portion of the upper tool to a support plate provided at a lower portion of said holder body; a clamping force adjusting device for adjusting a clamping force by said upper tool clamp; and a clamp releasing device for releasing the upper tool clamped by said upper tool clamp; and wherein said upper tool clamp is pivotally attached to said holder body in such a way that the lower portion of said upper tool clamp is movable toward and away from the support plate; said upper tool clamp is formed with a stop portion at a lower portion thereof so as to be engageable with and disengageable from an engage portion formed in the upper tool; and a plurality of pivotal ranges of said upper tool clamp are provided so that the stop portion of said upper tool clamp and the engage portion of the upper tool can be engaged with and disengaged from each other selectively in a horizontal direction or in a vertical direction.

Further, said clamping force adjusting device provided on the upper portion of said upper tool clamp includes a fastening screw screwed into the upper portion of said upper tool clamp; and an end portion of the fastening screw is in contact with said clamping force adjusting device provided for said holder body; and a lever attached to the fastening screw is so constructed as to be switchable, when the fastening screw is pivoted, from a first pivotal motion restriction state where the lever is brought into contact with stoppers provided for said holder body to a second pivotal motion free state where the lever is not brought into contact with the stoppers and pivotally movable beyond restriction or vice versa.

Further, the present invention provides an upper tool for a press brake, which comprises: a contact surface contactable to a lower surface of a support plate provided at a lower portion of a holder body of an upper tool holder apparatus attached to an upper table of a press brake; a slide surface slidably contactable to a front or rear surface of the support plate; an engage portion engageable with and disengageable from a stop portion of a wedge-shaped member vertically movably provided at a lower portion of an upper tool clamp pivotally attached to the upper tool holder apparatus; and a work processing portion for processing a work in cooperation with a lower tool.

DETAILED DESCRIPTION OF THE PREFERRED EMBODIMENTS

Figure 1:
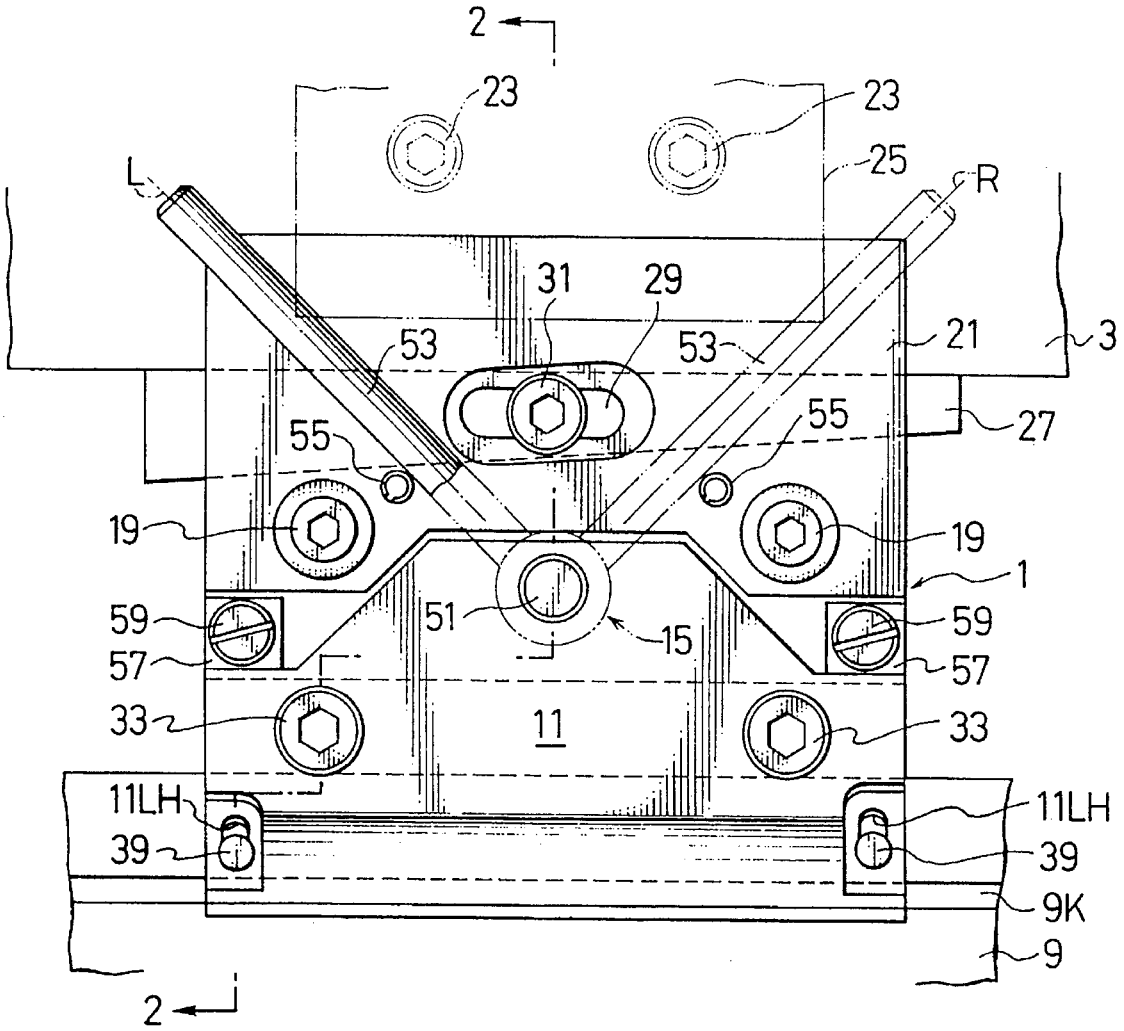
FIG. 1 is a front view showing a first embodiment of the upper tool holder apparatus according to the present invention.

The first embodiment of the upper tool holder apparatus according to the present invention will be described hereinbelow with reference to FIGS. 1 and 2.

The upper tool holder apparatus 1 is removably attached to the lower portion of an upper table 3 of a press brake (not shown). The upper tool holder apparatus 1 is provided with a holder body 5 removably attached to the upper table 3, an upper tool clamp 11 attached to the holder body 5 to push and fix an upper portion 9U of an upper tool 9 against and to a support plate 7 formed integrally with the lower portion of the holder body 5, a clamping force adjusting device 13 for adjusting the clamping force to the upper tool clamp 11, a clamp releasing device 15 for releasing the upper tool 9 clamped by the upper tool clamp 11, and a wedge-shaped member 17 movable up and down relative to the lower portion of the upper clamp 11 and formed with a stop portion 17K engageable with an engage portion 9K formed in the upper tool 9.

In more detail, the holder body 5 is formed with an upper block portion 5B having a thick wall extending in the front and rear direction (the right and left direction in FIG. 2) and a support plate 7 having a thin wall extending in the same direction and formed integral with the upper block portion 5B. Further, a mounting plate 21 is attached onto the front surface (on the left side surface in FIG. 2) of the upper block 5B of the holder body 5 with a plurality (two) of bolts 19 (see FIG. 1) so as to project upward from the upper end portion of the holder body 5.

Therefore, when the mounting plate 21 is brought into contact with the lower front surface portion of the upper table 3 and further a clamp jaw 25 is fastened with two fastening bolts 23 screwed into the upper table 3, since the upper mounting plate 21 can be pressed against the upper table 3, it is possible to mount the holder body 5 onto the upper table 3.

In order to adjust the vertical position of the holder body 5 relative to the upper table 3, the wedge member 27 extending horizontally (see FIG. 1) is interposed between the upper surface of the holder body 5 and the lower surface of the upper table 3. A fixing bolt 31 is passed through a slot 29 formed in the mounting plate 21 so as to extend in the horizontal direction, and is screwed into the wedge member 27 (see FIG. 2).

In the above-mentioned structure, under the condition that the clamp jaw 25 is fastened slightly to such an extent that the holder body 5 will not fall and in addition the fixing bolt 31 is unfastened, when the wedge member 27 is moved in the right and left direction in FIG. 1, it is possible to finely adjust the vertical position of the holder body 5 relative to the upper table 3.

Figure 2:
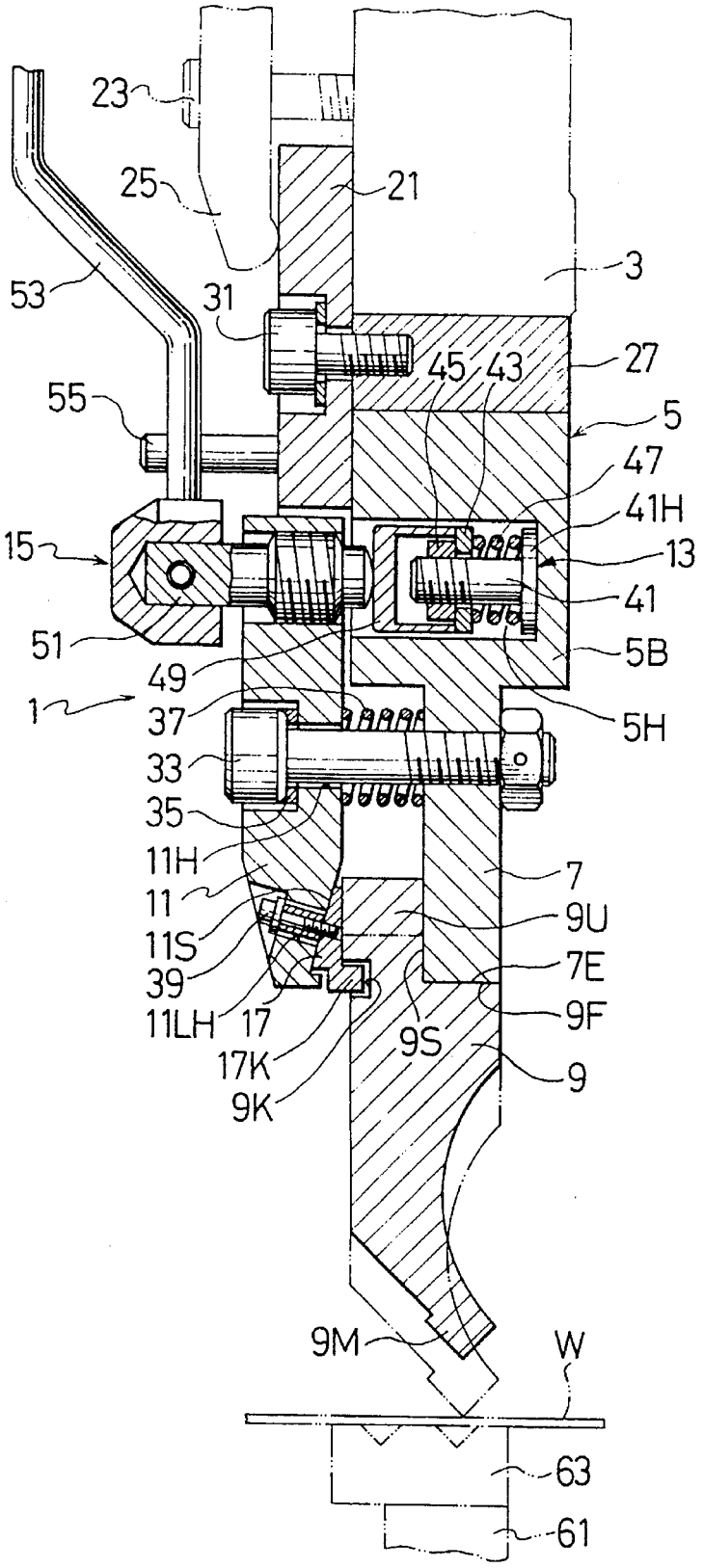
FIG. 2 is a cross-sectional view taken along the line 2—2 shown in FIG. 2.

The above-mentioned upper tool clamp 11 is a plate member having a width (in the right and left direction in FIG. 1) roughly the same as that of the holder body 5, and pivotally attached to the holder body 5 so as to fasten and fix the upper portion 9U of the upper tool 9 between the upper tool clamp 11 and the support plate 7 (as shown in FIG. 2).

In more detail, the upper clamp 11 is pivotally supported by a plurality of mounting bolts 33 passing through a plurality (two) of through holes 11H formed at roughly the vertically middle portion of the upper tool clamp 11 and fixedly fastened toward the support plate 7 in the horizontal direction. To facilitate the pivotal motion of the upper tool clamp 11, a spherical washer 35 is interposed between each head of the mounting bolts 33 and the upper tool clamp 11, as shown in FIG. 2. Further, two coil springs 37 are elastically interposed between the upper tool clamp 11 and the support plate 7 so as to be urged away from each other.

The upper tool clamp 11 is formed with an inclined surface 11S at the lower portion thereof, whose upper end portion is inclined toward the support plate 7. In contact with this inclined surface 11S, the wedge-shaped member 17 1s disposed so as to be movable up and down relative to the inclined surface 11S.

In more detail, the upper tool clamp 11 is formed with two slots 11LH extending in the oblique downward direction from the left side to the right side at the lower end portion thereof. Further, two mounting bolts 39 passing through these slots 11LH, respectively are screwed into the wedge-shaped member 17, so that the wedge-shaped member 17 can be attached to the upper tool clamp 11 so as to be movable up and down, because the two mounting bolts 39 are movable within the slots 11LH. Further, the wedge-shaped member 17 is formed with the projecting stop portion 17K at an appropriate position thereof so as to be engageable with the horizontal groove-shaped engage portion 9K formed in the upper tool 9.

Further, the clamping force adjusting device 13 is provided in a horizontal hole 5H formed in the upper block portion 5B of the holder body 5, so as to apply an adjustable clamping force to the upper tool 9 clamped between the upper clamp 11 and the support plate 7.

In more detail, as shown in FIG. 2, the clamping force adjusting device 13 is composed of an adjust screw 41, a ring member 43 loosely fitted to the adjust screw 41, a nut member 45 in mesh with the adjust screw 41 to adjust the position of the ring member 43, and an elastic member 47 such as a spring disposed between a head portion 41H of the adjust screw 41 and the ring member 43.

In the above-mentioned construction, it is possible to adjust the urging force of the elastic member 47 by adjusting the engage position of the nut member 45 relative to the adjust screw 41; that is, by adjusting the compression of the elastic member 47.

In the clamping force adjusting device 13, the head portion 41H of the adjust screw 41 is in contact with the inner bottom wall portion of the hole 5H, and further a cylindrical push member 49 (into which the nut member 45 is inserted) is in contact with the rlng member 43. Further, the end portion of the fastening screw 51 of the clamping force releasing device 15 provided on the upper tool clamp 11 is in contact with the push member 49.

In more detail, the clamp releasing device 15 is composed of the fastening screw 51 passing through and screwed into the upper portion of the upper tool clamp 11 and a lever 53 formed integral with the fastening screw 51.

Accordingly, when the lever 53 is pivoted, it is possible to fasten and unfasten the fastening screw 51 toward and from the cylindrical push member 49. Further, two right and left stopper pins 55 (see FIG. 1) are implanted in the mounting plate 21 to restrict the pivotal motion of the lever 15.

In the above-mentioned construction, as shown in FIG. 2, under the condition that the upper tool 9 is clamped between the support plate 7 of the holder body 5 and the upper clamp 11, when the lever 53 of the clamp releasing device 15 is pivoted clockwise to the rightward position (R) in FIG. 1 to fasten the fastening screw 51, since the elastic member 47 of the clamping force adjusting device 13 is further compressed, the elastic force of the elastic member 47 is increased, so that the upper tool 9 is more strongly fastened and fixed by the upper clamp 11 due to an increased reaction force caused by the elastic force of the elastic member 47.

In contrast with this, when the lever 53 of the clamp releasing device 15 is pivoted counterclockwise to the leftward position (L) in FIG. 1 to unfasten the fastening screw 51, the upper tool 9 is released from the clamping force of the upper tool clamp 11.

As described above, when the lever 53 is pivoted to fasten or unfasten the upper tool 9 through the upper clamp 11, the upper clamp 11 is pivoted clockwise or counterclockwise (leftward or rightward in FIG. 2) about the mounting bolt 33.

In order to guide the pivotal motion of the upper tool clamp 11 and further to restrict the vertical movement of the upper tool clamp 11, as shown in FIG. 1, a plurality of small restriction pieces (or members) 57 are attached to the holder body 5 with bolts 59 so as to be in contact with the upper surface of the upper tool clamp 11. Accordingly, the upper clamp 11 can fasten or fix the upper tool 9 at any predetermined position stably without being moved up and down.

As shown in FIG. 2, the upper tool 9 removably attached to the upper tool holder apparatus 1 constructed as described above is formed with a contact surface 9F brought into contact with a lower end surface 7E of the support plate 7. Further, the upper tool 9 is formed with the upper portion 9U projecting upward from the contact surface 9F and with a slide surface 9S brought into slidable contact with the front surface of the support plate 7. The groove-shaped engage portion 9K is formed on the surface opposite to the slide surface 9S. Further, the upper tool 9 is formed with a work processing portion 9M at the lower end portion thereof to bend a workpiece W in cooperation with a lower tool 63 attached to the lower table 61 of the press brake.

In the above-mentioned construction, in the case where the upper tool 9 has been removed from the upper tool holder apparatus 1, the upper tool 9 can be attached to the upper tool holder apparatus 1 as follows:

First, the lever 53 of the clamp releasing device 15 is pivoted clockwise in FIG. 1 to the rightward position (R) to fasten the fastening screw 51. Under these conditions, a space can be maintained between the support plate 7 and the wedge-shaped member 17 attached to the lower portion of the upper tool clamp 11, and the wedge-shaped member 17 is located at the lowermost position due to its weight.

Accordingly, it is possible to insert the upper portion 9U of the upper tool 9 into the space formed between the support plate 7 and the upper clamp 11 along the horizontal direction in such a way that the groove-shaped engage portion 9K formed in the upper tool 9 can engaged with the stop portion 17K of the wedge-shaped member 17.

Thereafter, the movable side of the upper table 3 and lower table 61 of the press brake is moved up and down to press the upper tool 9 to lower tool 63 correctly with each other. In this engagement process of both the upper tool 9 and lower tool 63, the upper tool 9 is generally moved upward relative to the holder body 5.

When the upper tool 9 is moved gradually upward relative to the holder body 5 as described above, since the wedge-shaped member 17 is also moved upward together with the upper tool 9, the upper tool clamp 11 is pivoted gradually in the clockwise direction in FIG. 2, so that the elastic member 47 of the clamping force adjusting device 13 is compressed gradually.

Accordingly, when the upper tool 9 is moved upward relative to the support plate 7 so that the contact surface 9F of the upper tool 9 is brought into contact with the lower end surface 7E of the support plate 7, the upper tool clamp 11 can clamp the upper portion 9U of the upper tool 9 more strongly due to the increased elastic force of the elastic member 47 of the clamping force adjusting device 13, with the result that it is possible to attach the upper tool 9 easily to the upper tool holder apparatus 1.

In the above-mentioned construction, in the case where the upper tool 9 has been already attached to the upper tool holder apparatus 1, the upper tool 9 can be removed from the upper tool holder apparatus 1 as follows:

First, the lever 53 of the clamp releasing device 15 is pivoted to the leftward position (L) in FIG. 1 to unfasten the fastening screw 51, so that the upper tool 9 is released from the fastening condition by the upper tool clamp 11.

When the upper tool 9 is released from the upper tool clamp 11, both the upper tool 9 and the wedge-shaped member 17 drop to the lowermost positions due to their weights, respectively. In this case, since the engage portion 9K of the upper tool 9 is engaged with the stop portion 17K of the wedge-shaped member 17, it is possible to prevent the upper tool 9 from being dropped, thus maintaining the safety. Under the condition that the upper tool 9 is released from the clamping condition by the upper tool clamp 11, when the upper tool 9 is moved in the horizontal direction, it is possible to easily remove the upper tool 9 from the upper tool holder apparatus 1.

As understood already, in the upper tool holder apparatus 1 according to the present invention, it is possible to attach and remove the upper tool 9 to and from the upper tool holder apparatus 1 easily, without use of any tool, in spite of the simple construction.

Figure 3:
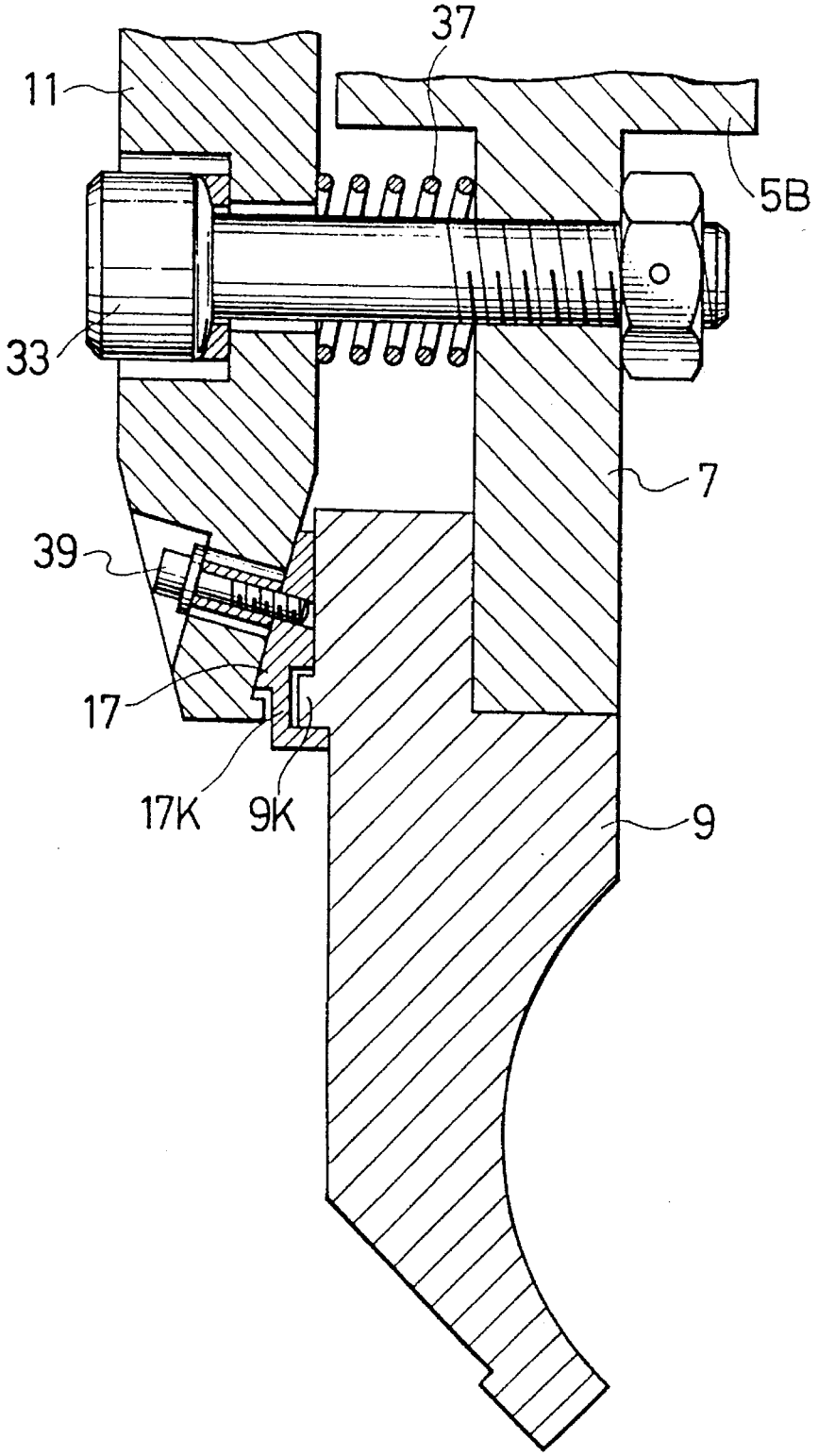
FIG. 3 Is a cross-sectional view showing the essential portion of a second embodiment of the upper tool holder apparatus according to the present invention.

FIG. 3 shows a second embodiment of the upper tool holder apparatus according to the present invention, in which the wedge-shaped member 17 is formed with a groove-shaped engage portion 17K, and the upper tool 9 is formed with a projecting engage portion 9K so as to be engageable with the groove-shaped engage portion 17K of the wedge-shaped member 17. The construction and the function of the second embodiment except above are the same as with the case of the first embodiment, and thereby the same effect as in the first embodiment can be obtained.

Figure 4:
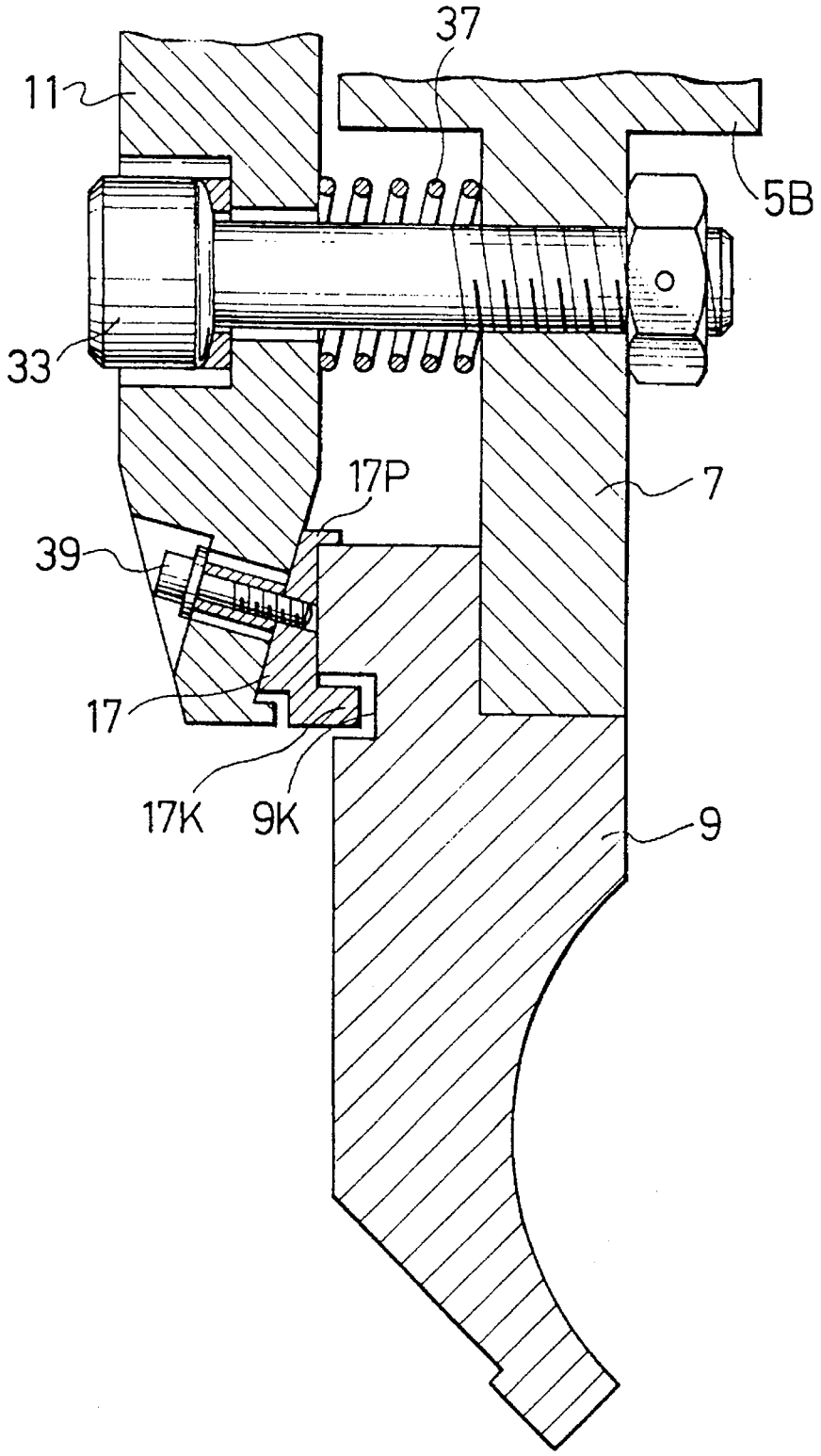
FIG. 4 is a cross-sectional view showing the essential portion of a third embodiment of the upper tool holder apparatus according to the present invention.

FIG. 4 shows a third embodiment of the upper tool holder apparatus according to the present invention, in which the wedge-shaped member 17 is additionally formed with an upper projecting engage portion 17P so as to be brought into contact with the upper surface of the upper tool 9. The construction and the function of the third embodiment except above are the same as with the case of the first and second embodiments, and thereby the same effect as in the first and second embodiments can be obtained.

Figure 5:
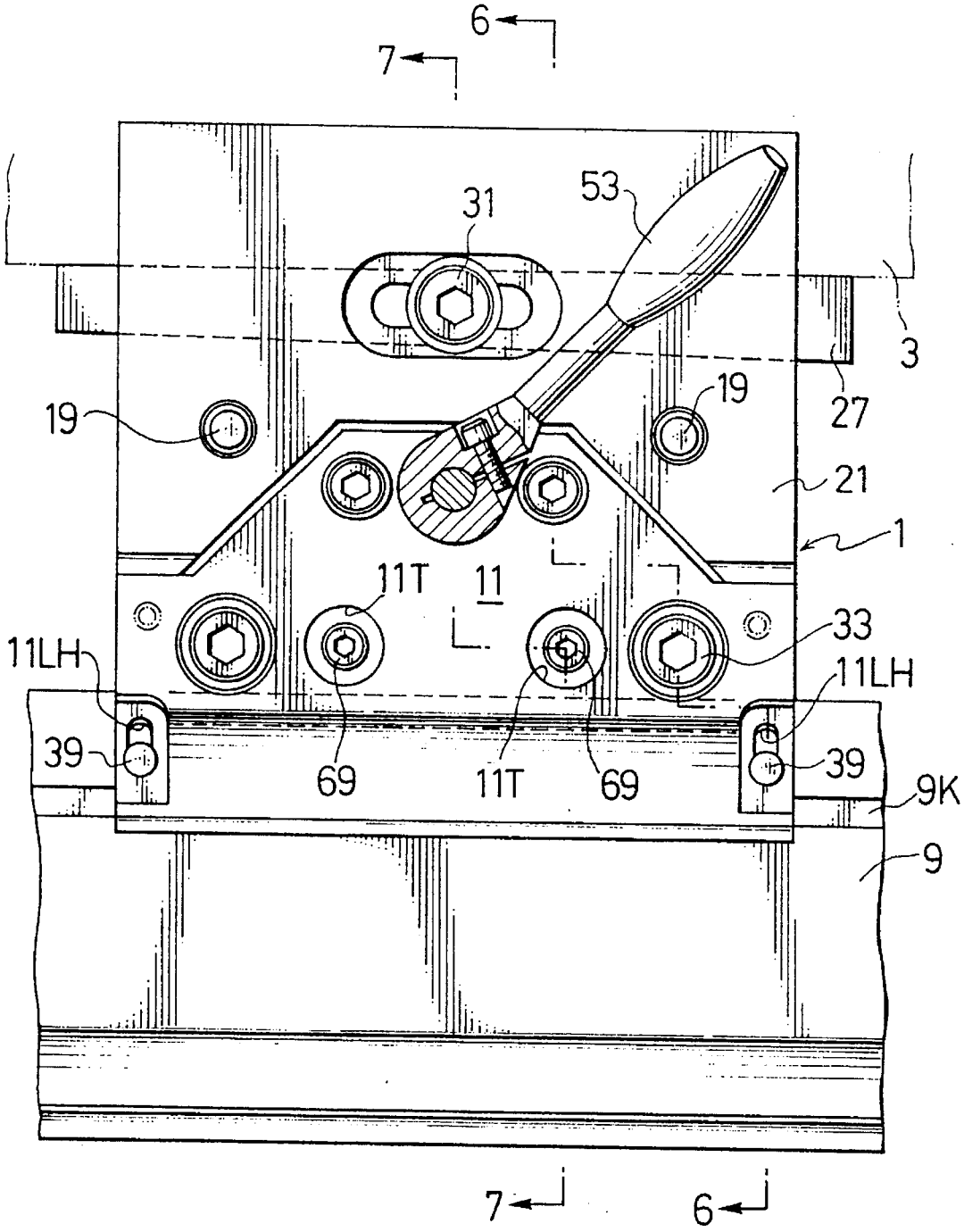
FIG. 5 is a front view showing an upper tool holder apparatus related to a fourth embodiment of the upper tool holder apparatus according to the present invention.
Figure 6:
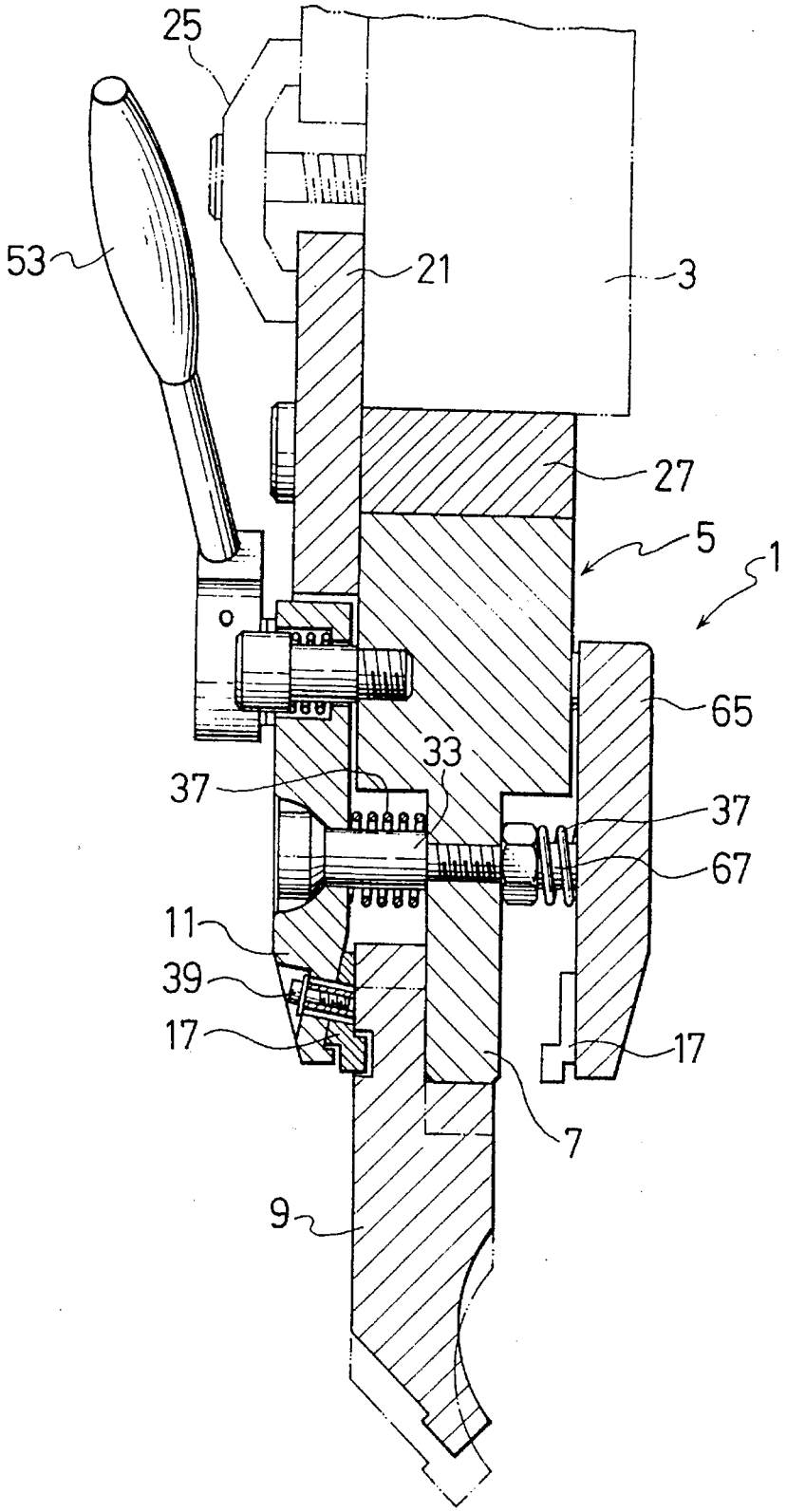
FIG. 6 is a cross-sectional view taken along the line 6—6 shown in FIG. 5.
Figure 7:
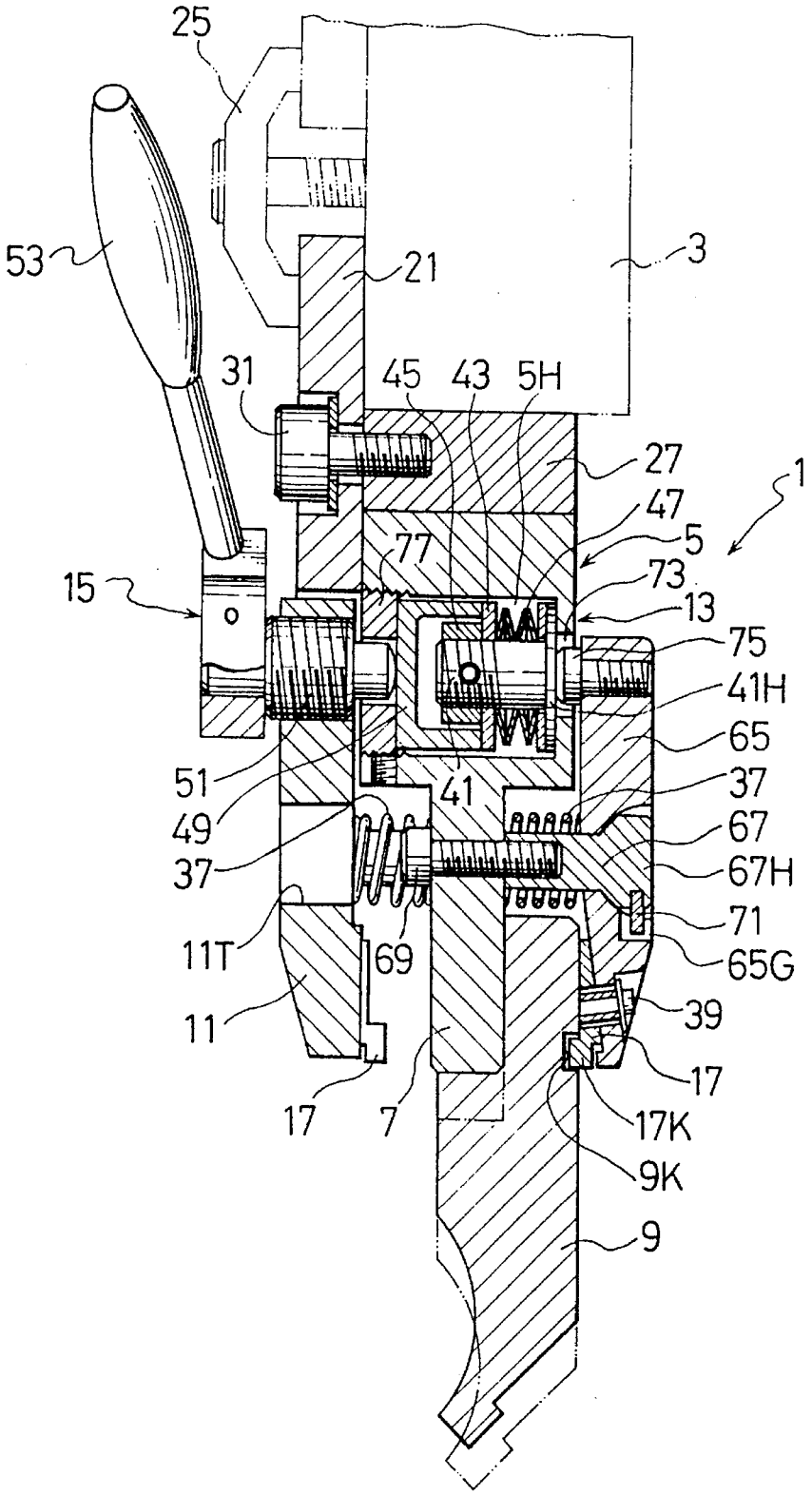
FIG. 7 is a cross-sectional view taken along the line 7—7 shown in FIG. 5.

FIGS. 5 to 7 show the fourth embodiment of the upper tool holder apparatus according to the present invention, in which both surfaces of the upper tool 9 can be reversed relative to each other and further an additional upper tool 9 can be attached to the rear surface side of the support plate 7 in cooperation with another rear side upper tool clamp 65. Accordingly, the same reference numerals have been retained for the similar parts or elements which have the same functions as with the case of the first embodiment, and only the points different from the first embodiment will be described hereinbelow, without repeating the similar detailed description thereof.

In order to attach the upper tool 9 onto the rear surface side of the support plate 7, the rear side upper tool clamp 65 is provided on the rear side of the support plate 7.

In more detail, as shown in FIG. 7, a stud 67 formed with a semi-spherical head 67H is provided horizontally by use of a mounting bolt 69 on the rear surface of the support plate 7 of the holder body 5. The rear side upper tool clamp 65 is pivotally supported by this stud 67.

To pivot the mounting bolt 69, a tool hole 11T is formed in the front side upper tool clamp 11. Further, a whirl-stop pin 71 is attached to the head portion 67H of the stud 67 so as to engaged with a groove 65G formed in the rear side upper tool clamp 65. Therefore, even when the mounting bolt 69 is rotated, the stud 67 will not be rotated.

To use in common the clamping force adjusting device 13 for front side upper tool clamp 11 and the rear side upper tool clamp 65, a small-diameter hole 73 is formed in the bottom wall portion of the hole 5H of the holder body 5. Further, a contact member 75 mounted on the upper portion of the rear side upper tool clamp 65 is passed through this small-diameter hole 73 and brought into contact with the head portion 41H of the adjusting screw 41.

Further, a ring nut 77 is screwed into the hole 5H on the left side (in FIG. 7) to restrict the movement of the push member 49 of the clamping force adjusting device 13.

In the above-mentioned structure, when the mounting bolt 69 screwed into the stud 67 is fastened, it is possible to push and fix the upper tool 9 against the rear side surface of the support plate 7 with the rear side upper tool clamp 65. In contrast with this, when the mounting bolt 69 is unfastened, the upper tool 9 is released from the rear side upper tool clamp 65.

Further, when the upper tool clamp 11 is kept unmovable under the condition that an appropriate member is interposed between the front side upper tool clamp 11 and the support plate 7, It is possible to fasten and unfasten the upper tool 9 by the rear-side upper tool clamp 65 with the use of the lever 53.

In summary, in the fourth embodiment, it is possible to selectively attach the upper tool 9 reversed in the front and rear direction to the support plate 7 according to the bending shape of the workpiece W. Further, the upper tool 9 can be attached to and removed from the upper tool holder apparatus 1 easily for tool exchange.

Figure 8:
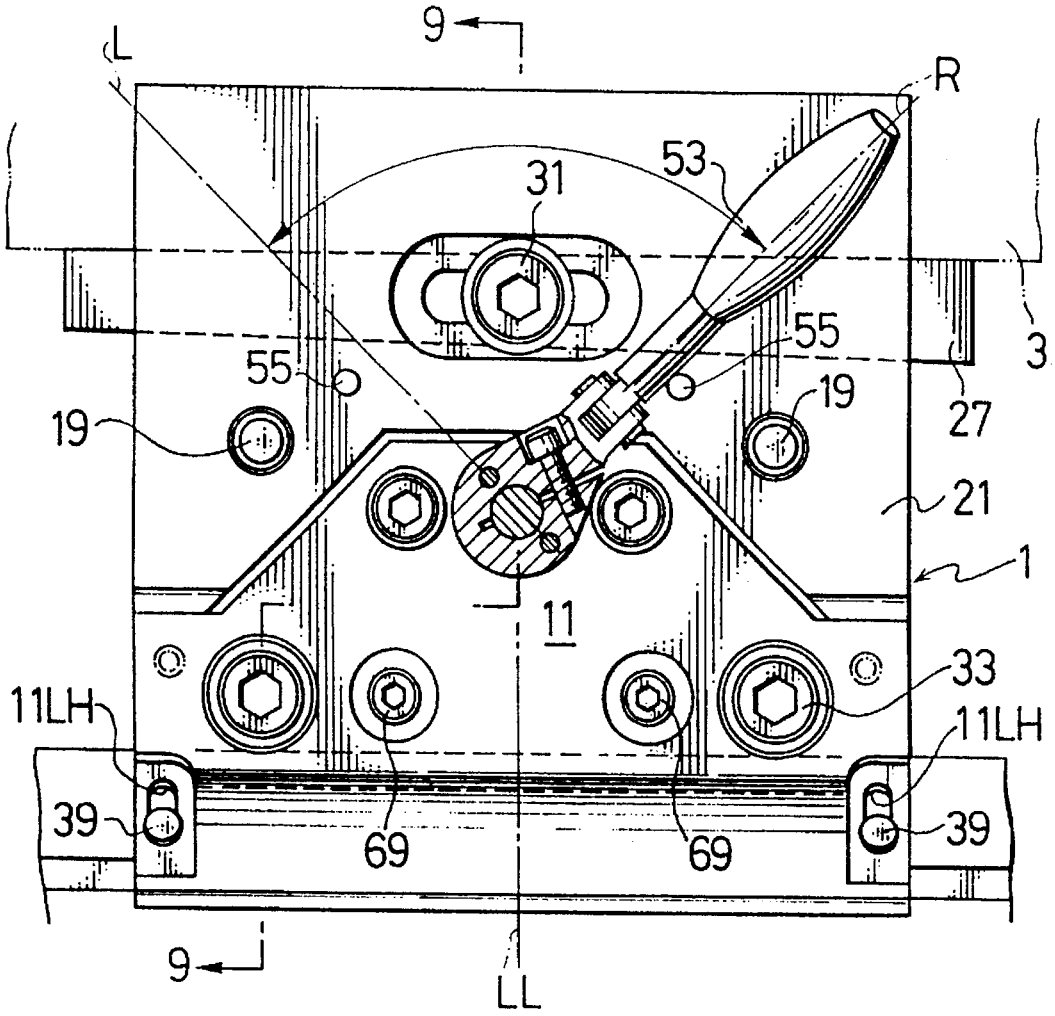
FIG. 8 is a front view showing an upper tool holder apparatus related to a fifth embodiment of the upper tool holder apparatus according to the present invention.
Figure 9:
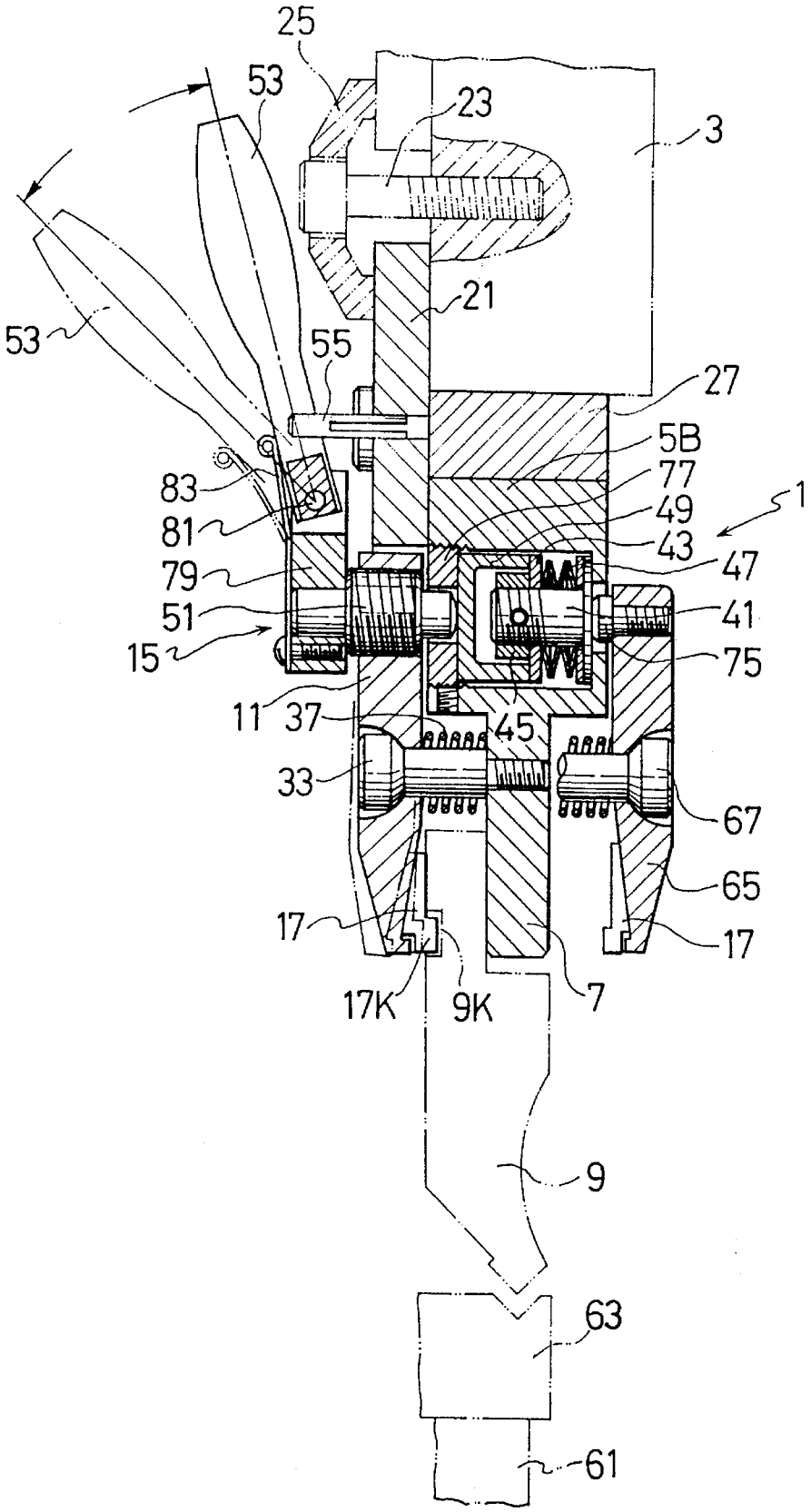
FIG. 9 is a cross-sectional view taken along the line 9—9 shown in FIG. 8.

FIGS. 8 and 9 show a fifth embodiment of the upper tool holding apparatus according to the present invention, in which the upper tool 9 can be attached to and removed from the upper tool holder apparatus 1 not only from the rightward and leftward directions but also from the downward direction as needed.

In more detail, in this fifth embodiment, the lever 53 is pivotally supported by a boss member 79 fixed to the fastening screw 51 of the clamp releasing device 15 via a pin 81. Further, the lever 53 is always kept by a leaf spring 83 mounted on the boss member 79 at such a position as to be brought into contact with the stopper pins 55 whenever pivoted.

Accordingly, under the normal conditions, the lever 53 can be pivoted within a restricted pivotal range between the right and left positions (R) and (L) determined by the two stopper pins 55, as shown by the dot-dashed lines in FIG. 8, as with the case of the first embodiment. However, when the lever 53 is pivoted in the counterclockwise direction in FIG. against the elastic force of the leaf spring 83, since the lever 53 can be pivoted without pivotal restriction by the stopper pins 55, the lever 53 can be pivoted beyond the stopper pins 55. That is, when the lever 53 is pivoted largely counterclockwise in FIG. 8 to the position (LL), for instance, since the fastening screw 51 can be shifted far away in the leftward direction in FIG. 9, it is possible to locate the lower end of the upper tool clamp 11 far away from the front surface of the support plate 7, as shown by the phantom lines in FIG. 9. Consequently, since the stop portion 17K of the wedge-shaped member 17 is dislocated far away from the engage portion 9K of the upper tool 9, it is possible to easily attach or remove the upper tool 9 thorough between the upper tool clamp 11 and the support plate 7 from below.

In summary, in this fifth embodiment, it is possible to switch a first pivotal motion restriction state where the lever is brought into contact with the stoppers 55 implanted in the holder body 5 to a second pivotal motion free state where the lever is not brought into contact with the stoppers 55 and thereby pivotally movable beyond the restriction range, or vice versa. In the first pivotal motion restriction state, the upper tool 9 can be attached to or removed from the upper tool holder apparatus 1 In the horizontal direction (rightward and leftward). In the second pivotal motion free state, however, the upper tool 9 can be attached to or removed from the upper tool holder apparatus 1 in the vertical direction (from below), so that it is possible to further improve the convenience of the upper tool exchange.

As described above, in the upper tool holder apparatus and the upper tool according to the present invention, it is possible to attach and remove the upper tool 9 to and from the upper tool holder apparatus 1 easily in spite of the simple construction, without dropping the upper tool 9 even when the upper tool 9 is released from the upper tool holder apparatus 1, thus improving the upper tool exchange work while maintaining the safety thereof.

What is claimed is:

1. A press brake, comprising:

a lower table to which a lower tool is attached, an upper table, and an upper tool holder attached to said upper table for removably supporting an upper tool, said upper tool being adapted to cooperate with said lower tool for bending a workpiece disposed therebetween;

said upper tool holder comprising:

a holder body attached to said upper table and provided with a support plate at a lower end thereof, a tool clamp attached to said holder body in such a way as to be pivotal about a center portion of said holder body, a lower portion of said tool clamp being adapted to clamp said upper tool onto said support plate, an elastic member provided between said holder body and an upper portion of said tool clamp for urging said upper portion of said tool clamp away from said holder body, and a wedge-shaped member vertically movably provided between said lower portion of said tool clamp and said upper tool.

2. The press brake according to claim 1, further comprising a clamp releasing device provided between said elastic member and said upper portion of said upper tool clamp for reducing an elastic force applied to said upper portion of said upper tool clamp by said elastic member.

3. An upper tool holder adapted to be mounted on an upper table of a press brake for removably supporting an upper tool, said upper tool holder comprising:

a holder body adapted to be mounted on said upper table and provided with a support plate at a lower end thereof;

a tool clamp attached to said holder body in such a way as to be pivotal about a center portion of said holder body, a lower portion of said tool clamp being adapted to clamp said upper tool onto said support plate;

an elastic member provided between said holder body and an upper portion of said tool clamp for urging said upper portion of said tool clamp away from said holder body; and a wedge-shaped member vertically movably provided between said lower portion of said tool clamp and said upper tool.

4. The upper tool holder according to claim 3, further comprising a clamp releasing device provided between said elastic member and said upper portion of said tool clamp for reducing an elastic force applied to said upper portion of said tool clamp by said elastic member.

5. The upper tool holder according to claim 4, wherein said clamp releasing device includes a screw provided in said upper portion of said tool clamp, said screw being movable toward and away from said holder body, said screw having a surface receiving the elastic force from said elastic member.

6. An upper tool holder adapted to be mounted on an upper table of a press brake for removably supporting an upper tool, said upper tool holder comprising:

a holder body adapted to be mounted on said upper table and provided with a support plate at a lower end thereof;

a tool clamp attached to said holder body in such a way as to be pivotal about a center portion of said holder body, a lower portion of said tool clamp being adapted to clamp said upper tool onto said support plate; and an elastic member provided between said holder body and an upper portion of said tool clamp for urging said upper portion of said tool clamp away from said holder body;

wherein said lower portion of said tool clamp is formed with an inclined surface adapted to engage with a wedge-shaped section which is provided between said lower portion of said tool clamp and said upper tool, and which is vertically movable together with said upper tool.

7. The upper tool holder according to claim 6, further comprising a clamp releasing device provided between said elastic member and said upper portion of said tool clamp for reducing an elastic force applied to said upper portion of said tool clamp by said elastic member.

8. A method for mounting an upper tool on a press brake, the press brake including a lower table to which a lower tool is attached, an upper table, and an upper tool holder attached to said upper table for removably supporting said upper tool, said upper tool being engageable with said lower tool for bending a workpiece disposed therebetween;

said upper tool holder including a holder body attached to said upper table and having a support plate at a lower end of said holder body, and a tool clamp mounted on said holder body in such a way as to be urged toward said holder body so that a lower portion of said tool clamp clamps said upper tool onto said support plate, said lower portion of said tool clamp being formed with an inclined surface adapted to engage with a wedge-shaped section which is provided between said lower portion of said tool clamp and said upper tool and which is vertically movable together with said upper tool;

the method comprising the steps of:

(a) placing an upper portion of said upper tool between said lower portion of said tool clamp and said support plate;

(b) moving said lower tool upward so that said lower tool engages with said upper tool; and (c) moving said lower tool further upward so that said upper tool and said wedge-shaped section move upward together until said lower portion of said tool clamp clamps said upper portion of said upper tool onto said support plate.

9. A method for mounting an upper tool on a press brake, comprising the steps of:

(a) providing said press brake with a lower table to which a lower tool is attached, an upper table, and an upper tool holder attached to said upper table for removably supporting said upper tool, said upper tool being engageable with said lower tool for bending a workpiece disposed therebetween;

(b) providing said upper tool holder with a holder body attached to said upper table and having a support plate at a lower end of said holder body, and a tool clamp mounted on said holder body in such a way as to be urged toward said holder body so that a lower portion of said tool clamp clamps said upper tool onto said support plate, said lower portion of said tool clamp being formed with an inclined surface adapted to engage with a wedge-shaped section which is provided between said lower portion of said tool clamp and said upper tool, and which is vertically movable together with said upper tool;

(c) placing an upper portion of said upper tool between said lower portion of said tool clamp and said support plate;

(d) moving said lower tool upward so that said lower tool engages with said upper tool; and (e) moving said lower tool further upward so that said upper tool and said wedge-shaped section move upward together until said lower portion of said tool clamp clamps said upper portion of said upper tool onto said support plate.

* * * * *